US007645049B2

(12) United States Patent
Finkle

(10) Patent No.: US 7,645,049 B2
(45) Date of Patent: Jan. 12, 2010

(54) CONTROL SYSTEM FOR LIQUID MOTION LAMP

(76) Inventor: Louis J. Finkle, 5012 Verdura Ave., Lakewood, CA (US) 90712

( * ) Notice: Subject to any disclaimer, the term of this patent is extended or adjusted under 35 U.S.C. 154(b) by 0 days.

(21) Appl. No.: 12/342,000

(22) Filed: Dec. 22, 2008

(65) Prior Publication Data

US 2009/0102386 A1 Apr. 23, 2009

Related U.S. Application Data

(62) Division of application No. 11/605,779, filed on Nov. 28, 2006, now Pat. No. 7,478,914.

(60) Provisional application No. 60/814,267, filed on Jun. 16, 2006.

(51) Int. Cl.
*F21V 33/00* (2006.01)

(52) U.S. Cl. ..... 362/101; 362/318; 362/806; 40/406

(58) Field of Classification Search ..... 362/101, 362/96, 562, 154, 155, 318, 806, 811; 40/406–407; 446/32, 49; 392/316, 318
See application file for complete search history.

(56) References Cited

U.S. PATENT DOCUMENTS

| | | | | |
|---|---|---|---|---|
| 2,278,383 | A * | 3/1942 | Rosenblatt | 40/406 |
| 2,383,941 | A * | 9/1945 | Otis | 40/406 |
| 2,453,177 | A * | 11/1948 | Abramson | 40/406 |
| 3,387,396 | A | 6/1968 | Smith | |
| 3,499,238 | A * | 3/1970 | Publicker | 40/406 |
| 3,570,156 | A | 3/1971 | Walker | |
| 4,419,283 | A | 12/1983 | Schneider | |
| 5,596,827 | A * | 1/1997 | Boulos | 40/406 |
| 5,778,576 | A | 7/1998 | Kaviani | |
| 6,604,835 | B2 | 8/2003 | Zale | |
| 6,681,508 | B2 | 1/2004 | Unger et al. | |
| 6,746,131 | B1 | 6/2004 | Goldstein et al. | |
| 7,478,914 | B2 | 1/2009 | Finkle | |
| 2003/0202340 | A1 | 10/2003 | Wu | |
| 2005/0183299 | A1 | 8/2005 | Lee | |
| 2006/0215397 | A1 | 9/2006 | Lee | |
| 2007/0246098 | A1 | 10/2007 | Burke et al. | |

FOREIGN PATENT DOCUMENTS

| | | |
|---|---|---|
| GB | 2399446 | 9/2004 |

* cited by examiner

*Primary Examiner*—Ali Alavi
(74) *Attorney, Agent, or Firm*—Kenneth L. Green; Edgar W. Averill, Jr.

(57) ABSTRACT

A control system for a liquid motion lamp maintains the proper temperature of liquids within the lamp to provide desired motion within the lamp, and reduces sensitivity to ambient temperature. The lamp preferably includes two heating elements, a first element for initial heating, such as a heat blanket, resistive glass coating, or a submerged ring, and a second heating element generally providing both heat and lighting. A sensor measures the temperature of the liquid inside the lamp and the control system controls the heat sources to maintain the temperature within operating limits.

14 Claims, 10 Drawing Sheets

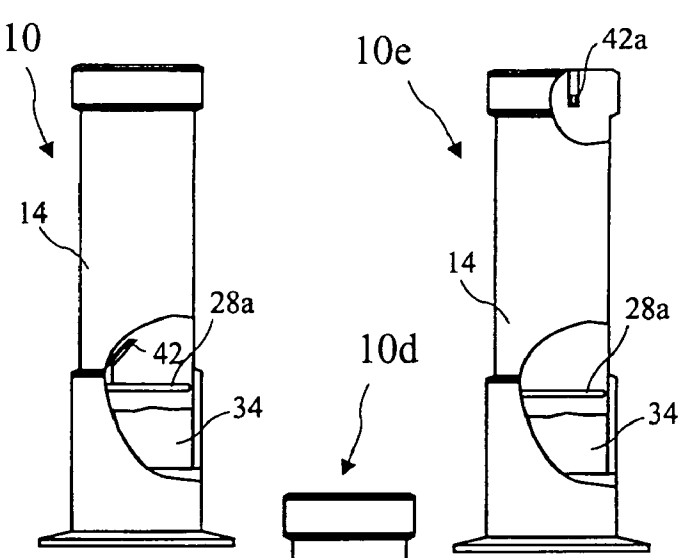
FIG. 5A
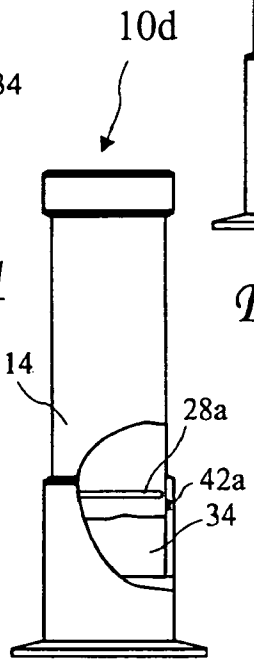
FIG. 5B
FIG. 5C
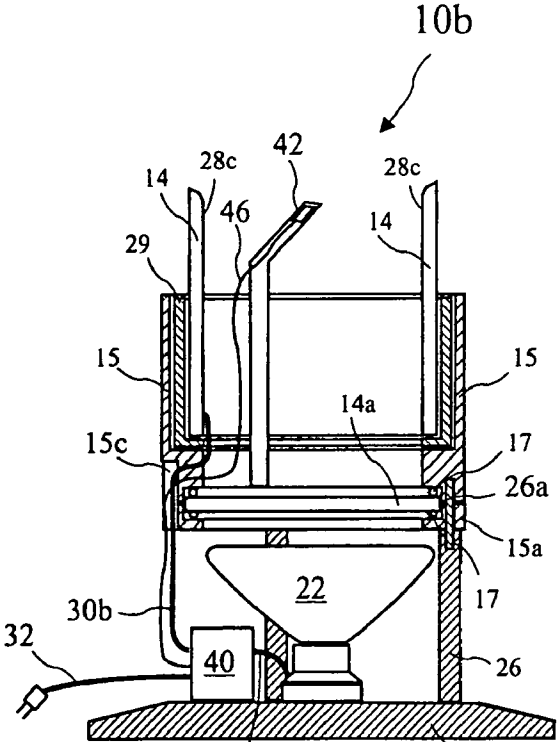
FIG. 4C
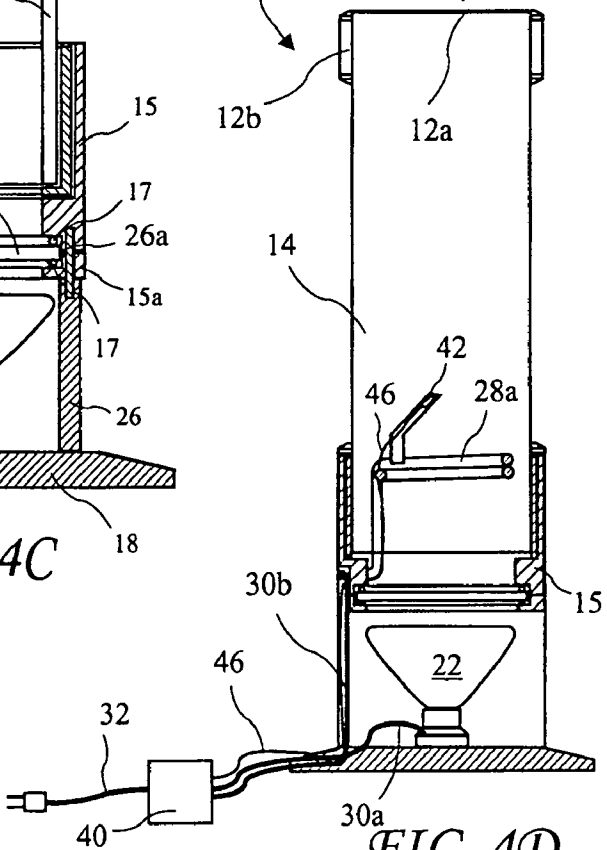
FIG. 4D

CONTROL SYSTEM FOR LIQUID MOTION LAMP

The present application is a Divisional of U.S. patent application Ser. No. 11/605,779 filed on Nov. 28, 2006 which claimed the benefit of U.S. Provisional Application Ser. No. 60/814,267, filed Jun. 16, 2006, which application is incorporated herein by reference.

BACKGROUND OF THE INVENTION

The present invention relates to decorative lighting and in particular to a liquid motion lamp.

Liquid motion lamps, commonly called "lava lamps" have been known since the 1960s. Such lamp is described in U.S. Pat. No. 3,387,396 for "Display Devices." The '396 patent describes a lamp having globules of a first liquid suspended in a second liquid, wherein the first liquid has a thermal expansion coefficient providing sufficient expansion, and therefore reduction in density, such that the first liquid is heavier than the second liquid at a lower temperature, and lighter than the second liquid at a higher temperature. The temperatures may be, for example, 45 degrees Centigrade and 50 degrees Centigrade. The first and second liquids are contained in a clear container having a heat source at the bottom, and as a result, the first liquid is heated, rises within the second liquid, cools, and drops back to the bottom of the container. At least one of the liquids is preferably colored, and provides an entertaining motion for an observer. Lamps such as described by the '396 patent are typically small and are sold as a sealed unit.

Unfortunately, known lamps often exhibit erratic behavior because of temperature fluctuations. The internal lamp temperature fluctuates with ambient temperature and the liquids fail to behave as intended. Further, high temperatures can cause the liquids to break down.

Recently, liquid motion lamps have gained popularity, and there is a desire to use such lamps in various commercial settings, for example hotel lobbies, clubs, lounges, etc. There is a desire that such lamps used in a commercial setting be substantially larger than known liquid motion lamps, but shipping such large lamps filled with liquid results in a high probability of damage and high shipping costs. U.S. patent application Ser. No. 10/856,457 filed Jun. 1, 2004 by the present applicant discloses a liquid motion lamp which may be shipped dry, and filled with a liquid at it's final destination. The dry shipment thus makes large liquid motion lamps much more practical. However, such large lamps are being used in luxurious settings where the appearance of the motion in the lamps is very important, and the large lamps may not behave consistently due to temperature fluctuations, particularly with tall lamps, for example, over five feet high. If the temperature is not carefully controlled, the desired visual affects may not be achieved. For example, too high of temperatures may cause the first liquid to remain near the top of the container, and cause clouding. Too low of temperatures will result in the first liquid failing to rise a desired amount. The '457 application is herein incorporated by reference.

BRIEF SUMMARY OF THE INVENTION

The present invention addresses the above and other needs by providing a control system for a liquid motion lamp. The control system maintains the proper temperature of liquids in the lamp to provide desired motion within the lamp, and reduces sensitivity to ambient temperature. The lamp preferably includes two heating elements, a first element generally providing lighting and heat, and a second heating element such as a heat blanket, resistive glass coating, or a submerged ring, for initial heating or for when additional heat is required for proper operation of the lamp. A sensor measures the temperature of the liquid inside the lamp, and the control system controls the heat sources to maintain the temperature within operating limits.

In accordance with one aspect of the invention, there is provided a liquid motion lamp including a container, a base portion, a first liquid suitable for residing in the container, a second liquid suitable for residing in the container, a first heat and light source, a second heat source, a temperature sensor, and a control system. The first liquid is a solid at room temperature, a liquid at a lower operating temperature, and a liquid at a higher operating temperature. The second liquid is a liquid at room temperature, wherein the first liquid has a lower density than the second liquid at the higher operating temperature and a greater density than the second liquid at the lower operating temperature. The base portion resides substantially below the container and the first heat and light source resides within the base portion. The second heat source is configured to be in thermal cooperation with the second liquid when the lamp is in use. The sensor measures the temperature of the second liquid and the control system receives measurements from the sensor and controls the first heat source and the second heat source.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 4C is a detailed view of a bottom portion of the cross-sectional view of the liquid motion lamp taken along line 4-4 of FIG. 1, showing bottom sealing details and a second heat source comprising a resistive coating residing on the interior of the container.

FIG. 4D shows the liquid motion lamp with an external control connected to the lamp by wiring.

FIG. 5A shows the liquid motion lamp with a temperature sensor residing above a first liquid residing in the bottom of the container portion.

FIG. 5B shows the liquid motion lamp with a temperature sensor residing on an outer surface of the container.

FIG. 5C shows the liquid motion lamp with a temperature sensor residing proximal to the top of the container.

Corresponding reference characters indicate corresponding components throughout the several views of the drawings.

DETAILED DESCRIPTION OF THE INVENTION

Figure 1:
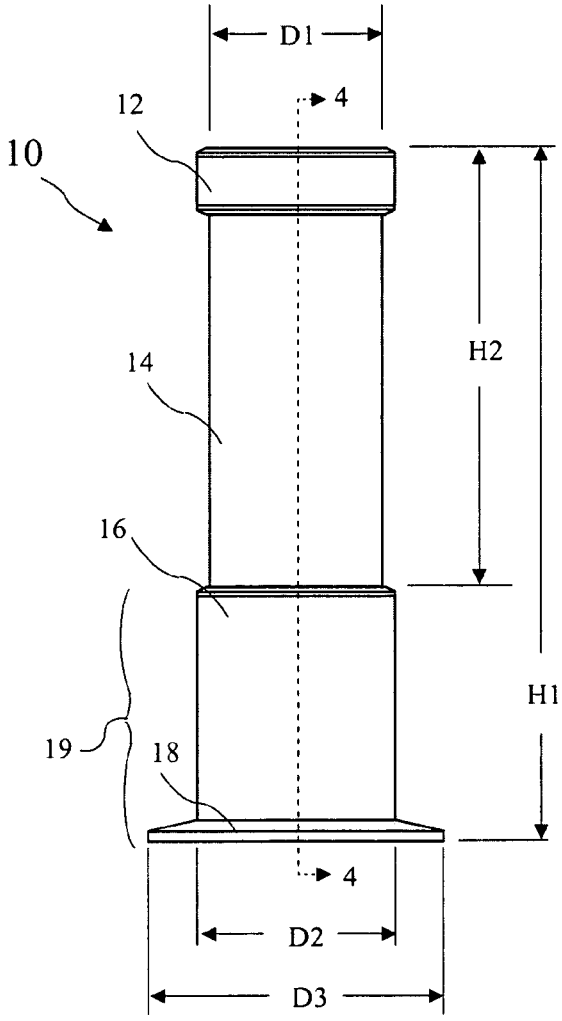
FIG. 1 is liquid motion lamp according to the present invention.

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Liquid motion lamps, or lava lamps, are well known as small home decorative lighting. U.S. Pat. No. 3,387,396 for "Display Devices," U.S. Pat. No. 3,570,156 for "Display Devices," and U.S. Pat. No. 5,778,576 for "Novelty Lamp," describe such lamps. A detailed description of liquids used in such lamps is provided in U.S. Pat. No. 4,419,283 for "Liquid compositions for display devices." Construction of a large liquid motion lamp is disclosed in U.S. patent application Ser. No. 10/856,457 filed Jun. 1, 2004 by the present applicant. The '396, '156, '576, and '283 patents are herein incorporated by reference. The '457 application was incorporated by reference above.

Although basic home lava lamps have become commonplace, large versions for commercial use have not been entirely practical for various reasons. The liquid motion lamp 10 shown in FIG. 1 overcomes these obstacles. The lamp 10 includes a top piece 12, a container 14, and a base portion 19 including a base cover 16 and a base flange 18. The container 14 is preferably transparent and more preferably made from boro silicate glass or any clear stable plastic, for example, acrylic or poly carbonate. The top piece 12, base cover 16, and base flange 18 are preferably made from cast aluminum. The container 14 preferably extends into the base portion 19, and preferably, at least part of the base portion 19 is below the bottom of the container 14.

Figure 2:
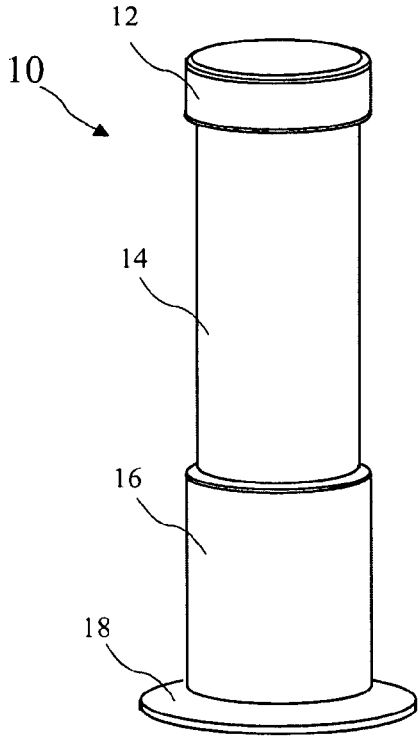
FIG. 2 shows a perspective view of the liquid motion lamp.

The container 14 diameter D1 is preferably between six inches and 36 inches, the base cover diameter D2 is preferably between approximately one inch and approximately two inches greater than the container diameter D1, and the base flange diameter D3 is preferably between approximately two inches and approximately twelve inches greater than the container diameter D1. The overall height H1 of the lamp 10 is preferably between approximately three feet and approximately nine feet, and the height H2 of the visible portion of the container 14 is preferably between approximately two feet and approximately six feet While the primary advantages of the present invention are directed to a lamp 10 having the preferred dimensions, any lamp including the present invention described herein is intended to come within the scope of the present invention. A perspective view of the lamp 10 is shown in FIG. 2.

Figure 3A:
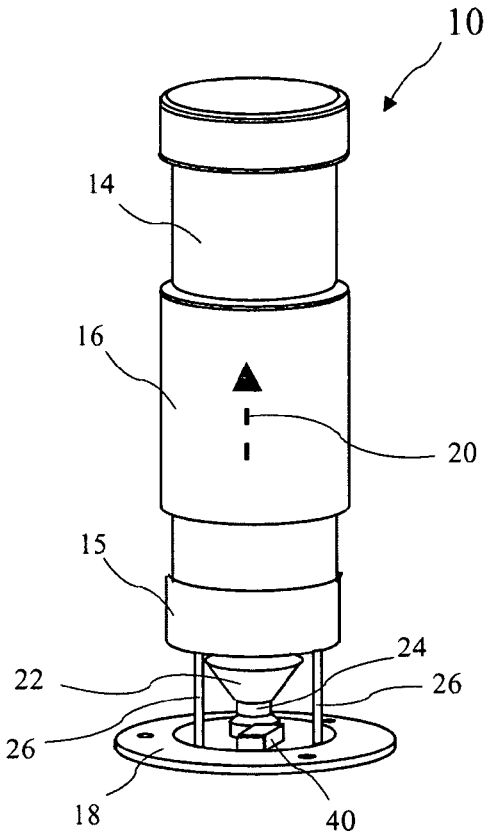
FIG. 3A shows the liquid motion lamp with a base cover raised to gain access to a first heating element and a control system.
Figure 3B:
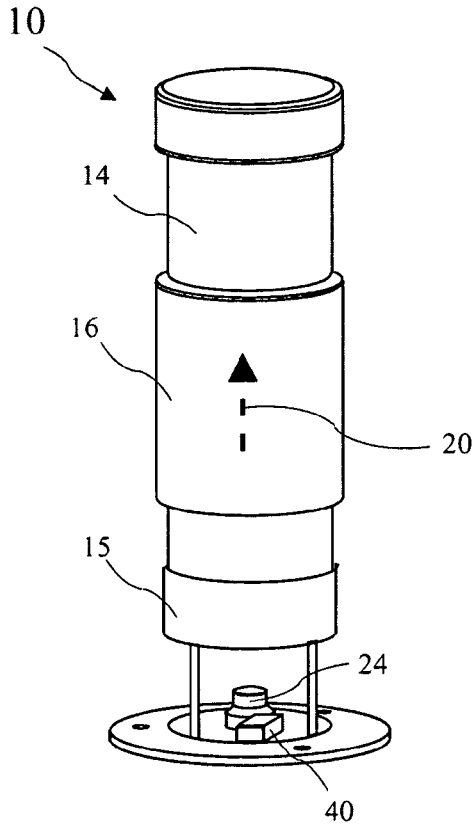
FIG. 3B shows the liquid motion lamp with a base cover raised and with the first heating element removed.

A lamp 10 intended for use in a commercial setting, for example, hotel lobbies, clubs, lounges, etc., may be much larger and heavier than known lava lamps. As a result, it is not practical to lift or move the lamp 10 to replace a heat source which has failed or to adjust controls 40. To address replacement of the heat source, the base cover 16 is vertically moveable along an arrow 20 as shown in FIG. 3A. With the base cover 16 raised, a first heat source 22 and the control 40 are accessible. The heat source 22 is preferably also a light source, and is more preferably an incandescent light bulb. The heat source 22 is electrically and mechanically connected to a socket 24. A view of the lamp 10 with the heat source 22 removed is shown in FIG. 3B. The container 14 is preferably supported by supports 26 residing between the base flange 18 and the container 14. There are preferably three supports 26, and a container base 15 proximal to the bottom of the container 14. The supports 26 connect to the base portion 15, and the container 14 is held by the base portion 15. While a first heat source 22 comprising a single light (for example an incandescent bulb) is shown in FIG. 3A, the first heat source 22 may also comprise one, two, three, or more lights, for example, a single 450 watt bulb or three 150 watt bulbs for a large lamp, or a single 150 watt bulb for a small lamp.

Figure 4B:
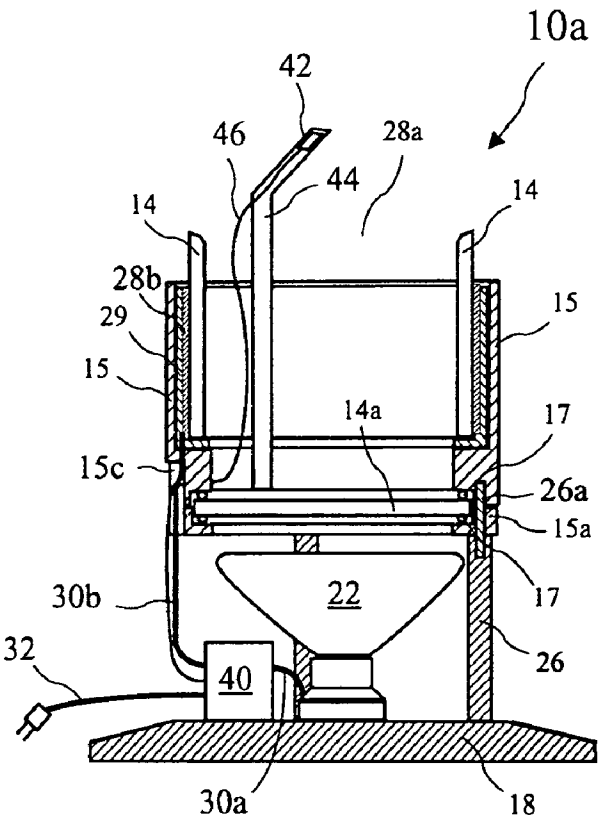
FIG. 4B is a detailed view of a bottom portion of the cross-sectional view of the liquid motion lamp taken along line 4-4 of FIG. 1, showing bottom sealing details and a second heat source comprising a heat blanket residing on the exterior of the container.
Figure 4A:
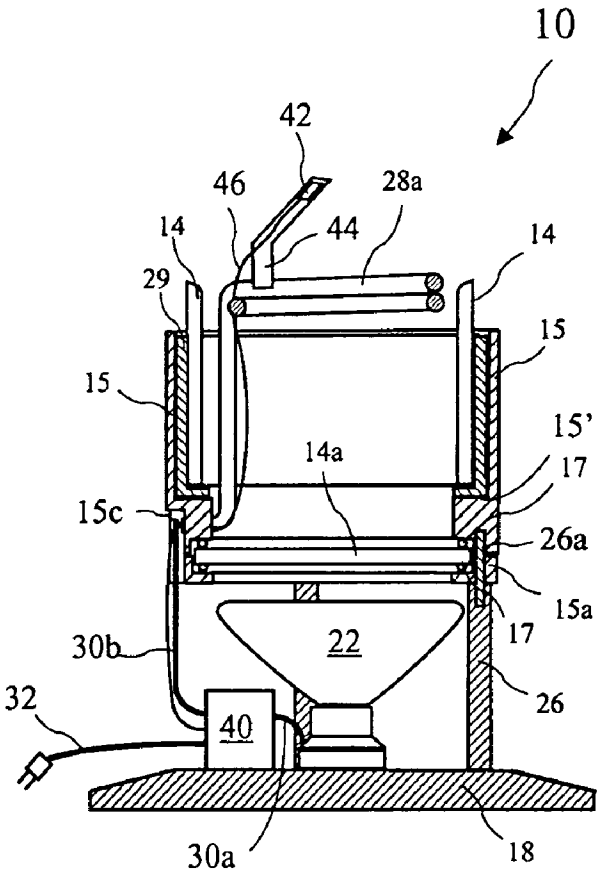
FIG. 4A is a detailed view of the bottom portion of the cross-sectional view of the liquid motion lamp taken along line 4-4 of FIG. 1, showing bottom sealing details and a second heat source comprising a circular heating element suitable for immersion in the second liquid.
Figure 4:
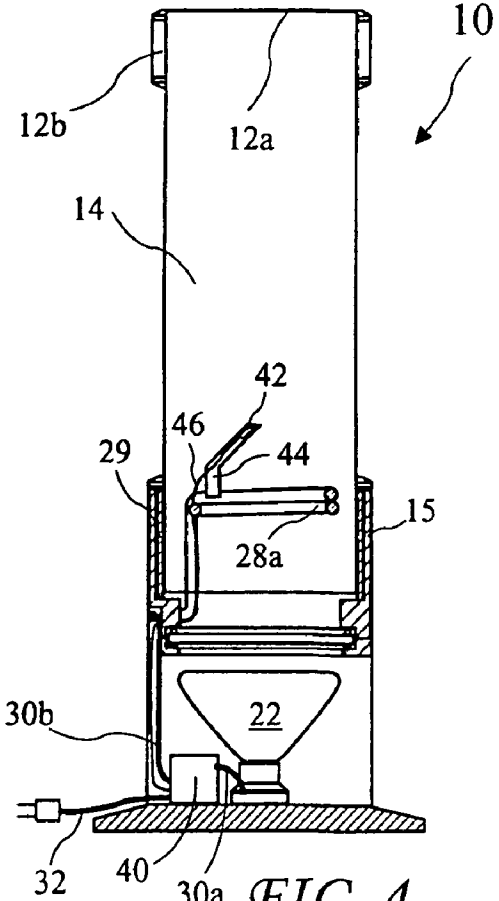
FIG. 4 shows a cross-sectional view of the liquid motion lamp taken along line 4-4 of FIG. 1, showing a second heating element.

A cross-sectional view of the lamp 10 taken along line 4-4 of FIG. 1 is shown in FIG. 4. A second heat source comprising a heating coil 28*a* is shown inside the container 14, and a thermal sensor 42 is supported by a sensor arm 44 attached to the heating coil 28*a*. The heating coil 28*a* is preferably an approximately 350 watt (for a small lamp) to approximately 1,000 watt (for a large lamp) heat coil and is substantially concealed (e.g., not visible from the side) when the base cover 16 is in place. The top piece 12 comprises a round cover 12*a* for the container 14 and a short cylindrical portion 12*b* for positioning the top piece 12 on the container 14. The top piece 12 is preferably fabricated from the same material as the base cover 16 and the base flange 18, and preferably provides a moisture proof seal to the container 14.

The sensor 42 is preferably a Resistive Thermal Device (RTD) sensor, but may be any electronic, electro mechanical or non-contact infared temperature or thermal optical device. An example of a suitable sensor 42 is an LM34 manufactured by National Semiconductor in Santa Clara, Calif. Another suitable sensor 42 is a series 5100 Hermetically Sealed Immersion-Type Thermostat made by Airpax in Frederick, Md.

The sensor arm 44 is preferably made from a thermally conductive material, and attaching the sensor arm 44 to the heating coil 28*a* provides a thermally conductive path between the heating coil 28*a* and the thermal sensor 42. If the lamp is turned on without liquid in the lamp, the heating sensor 42 will be rapidly heated by heat conducted by the sensor arm 44, and an overheated condition may be detected and the lamp turned off before damage to the lamp occurs.

Although liquid motion lamps may function properly with a fixed amount of heat provided to the liquids, in general, the best visual effects are not obtained if the temperature of the liquids falls outside an intended temperature range. The temperature of the second liquid at the base of the lamp must be sufficient to heat the first liquid to a temperature where the density of the first liquid is less than the density of the second liquid so that the first liquid rises to near the top of the container, and the temperature of the second liquid at the top of the container must be low enough to cool the first liquid to a temperature where the density of the first liquid is greater than the density of the second liquid so that the first liquid falls proximal to the bottom of the container. If the temperature of the second liquid in the base is low, the first liquid will not be heated sufficiently to rise proximal to the top of the container, and if the temperature of the second liquid in the top of the container is too high, the first liquid will remain proximal to the top of the container. In particularly, large and/or tall lamps the temperature of the second liquid must be carefully controlled to maintain proper behavior of the second liquid.

To provide the desired behavior of the first liquid, the lamp 10 according to the present invention includes a control circuit 40. The control circuit 40 may reside in the base of the lamp (see FIGS. 4-4C), or be located outside the lamp (see FIG. 4D). The control circuit is preferably a programmable control circuit 50 as described in FIGS. 7-11B, however, the control circuit may simply comprise a variable resistance sensor, for example a bi-metal device, and relays controlled by the variable resistance sensor to control the heaters 22, 28*a*, 28*b*, and 28*c* (see FIG. 4A-4C). The present invention may also be practiced without a second heat source, thereby impacting the start-up time, but not necessarily the operation of the lamp 10.

Sensor wires 46 electrically connect the sensor 42 to the control circuit 40 providing temperature measurements, first heater wires 30*a* connect the heater 22 to the control circuit 40 providing power to the heater 22, and second heater wires 30*b* connect the heater 28*a* to the control circuit 40 providing power to the heater 28*a*. Wires 32 provide electrical power to the control circuit 40.

A detailed view of a bottom portion of the cross-sectional view of the liquid motion lamp 10 taken along line 4-4 of FIG. 1 is shown in FIG. 4A showing bottom sealing details. The base 15 surrounds and supports the bottom of the container 14. The container base 15 includes a shelf 15' reaching under a lower edge of the container 14 to provide vertical support. A sealing material 29 resides between vertical walls of the base 15 and the container 14, and between the bottom edge of the container 14 and the shelf 15'. The base 15 cooperates with a base ring 15*a* to sandwich a container bottom 14*a*. Seals, which are preferably O-rings 17, reside between the bottom 14*a* and the base 15 and between the bottom 14*a* and the base ring 15*a*. The supports 26 (see FIGS. 3A, 3B) are preferably attached to the base 15 using support studs 26*a*, passing through the base ring 15*a*, thereby joining the base ring 15*a* to the base 15, and compressing O-rings 17. The container bottom 14*a* is preferably fabricated from a transparent material to pass light from the heat source 22 into the container 14, and the container bottom 14*a* is more preferably made from the same material as the container 14. A recess 15*c* in the base 15 and base ring 15*a* provide space for the wires 30*b* and 46 to pass downward inside the base cover 16.

A detailed view of a bottom portion of the cross-sectional view of a liquid motion lamp 10*a* taken along line 4-4 of FIG. 1 is shown in FIG. 4B, with a second heat source comprising a heat blanket 28*b*. The blanket 28*b* preferably resides between the base 15 and the container 14, and is preferably potted in the sealant 29. The heating blanket 28*b* is preferably an approximately 350 watt (for a small lamp) to approximately 1,000 watt (for a large lamp) heating blanket. The lamp 10*a* is otherwise similar to the lamp 10.

A detailed view of a bottom portion of the cross-sectional view of a liquid motion lamp 10*b* taken along line 4-4 of FIG. 1 is shown in FIG. 4C, with a second heat source comprising a resistive coating 28*c* on the interior of the container 14. The resistive coating 28*c* is preferably an approximately 350 watt (for a small lamp) to approximately 1,000 watt (for a large lamp) resistive coating. The lamp 10*b* is otherwise similar to the lamp 10.

A detailed cross-sectional view of a liquid motion lamp 10*c* taken along line 4-4 of FIG. 1 is shown in FIG. 4D, with the control circuit 40 residing outside the lamp 10. The control circuit 40 may reside at any distance from the lamp which is compatible with the power requirements of the heaters and with the sensor signal from the sensor 42, and wherein the heater wires 30*a* and 30*b* do not have excessive resistance. The lamp 10*b* is otherwise similar to the lamp 10.

When the lamp 10 is in use, the container 14 is substantially filled with two immiscible liquids. The lamp 10 is shown in cut-away in FIG. 5A with the first liquid 34 residing in the bottom of the container 14, which first liquid 34 is preferably a solid at room temperature and preferably reside behind the base cover 16 when solidified, and is preferable below the heating element 28*a* when solidified. The second liquid (not shown) is preferably liquid at room temperature and more preferably comprises water.

A lamp 10*d* including a surface mounted temperature sensor 42*a* is shown in FIG. 5B. The sensor 42*a* is preferably mounted on an outside surface of the container 14 and positioned behind the base 15. When such sensor 42*a* is used, the temperature measurements are slightly lower (for example, approximately five degrees Fahrenheit) than the measurements made by a sensor immersed in the second liquid and using the coil heater 28*a*, and may be slightly higher than the measurements made by sensor immersed in the second liquid and using the heat blanket 28*b* or the resistive coating 28*c*. Temperature settings for the control circuit 40 are adjusted accordingly.

A lamp 10*e* with the temperature sensor 42 residing proximal to the top of the container 14 is shown in FIG. 5C. The surface mounted sensor 42*a* may similarly be mounted inside the cylindrical portion 12*b* (see FIG. 4).

The first liquid 34 has greater density than the second liquid at room temperature. When heated to operating temperature, the first liquid 34 becomes less dense than the second liquid and rises in the container 14, thereby creating liquid motion. As the first liquid 34 rises in the container 14, the first liquid 34 cools sufficiently to become more dense than the second liquid, and thus drops back to the bottom of the container 14 where the first liquid 34 is again heated. The lamp preferably operates at between approximately 110 degrees Fahrenheit and approximately 120 degrees Fahrenheit.

An exemplar first liquid 34 is a paraffin based thermally expansive material, and preferably a combination of chlorinated paraffin and paraffin. The paraffin is preferably a low melting temperature paraffin, and more preferably a low oil content paraffin, and most preferably a less than three percent oil content paraffin, also known as a scale wax. The paraffin is preferably a low melting temperature paraffin to allow a low operating temperature for the lamp. A surfactant is preferably added to the container to reduce surface tension of the liquids, and a binder is preferably added to prevent the paraffin and chlorinated paraffin from separating. The surfactant is preferably a high cloud point surfactant, and the binder is preferably Polyboost binder made by Hase Petroleum Wax Co. in Arlington Heights, Ill.

While the lamp described in FIGS. 4-5C includes a first and a second heater, a lamp with only a single heater, a temperature sensor, and a temperature control is intended to come within the scope of the present invention. Further, both large lamps and desk top lamps including at least one heater, a temperature sensor, and a temperature control is intended to come within the scope of the present invention.

Figure 6:
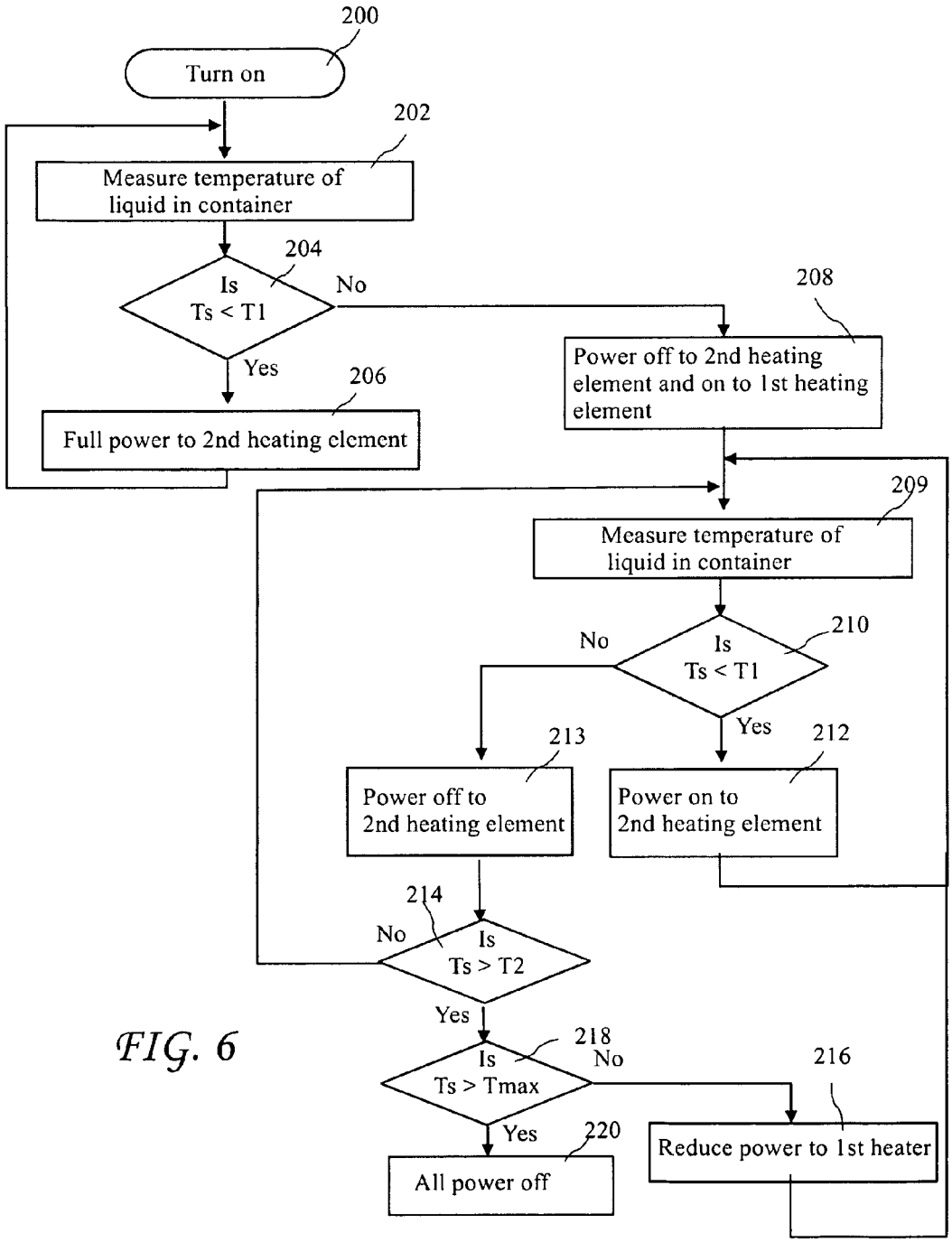
FIG. 6 describes a method for controlling the liquid motion lamp.

A method for controlling the liquid motion lamp 10 is described in FIG. 6. The lamp is turned on at step 200. The temperature Ts of the liquid in the container is measured at 202. Ts is compared to a lower temperature T1 at step 204. If Ts is less than T1, full power is provided to the second heater at step 206, and the control logic returns to step 202 to again measure the temperature Ts. If Ts is not less than T1, the second heater is turned off and power is provided to the first heater at step 208. The temperature Ts is again measured at step 209. After power is provided to the first heater, the sensor temperature Ts is again compared to the lower temperature threshold T1 at step 210, and if Ts is less than T1, power is again provided to the second heater at step 212 and the temperature Ts is again measured at step 209 after a very short time period. In this instance, the power may be a single power level, one of a plurality of discrete power levels selected based on the difference between Ts and T1, or may be a variable power lever which is a function of T1-Ts. For example, power may be either full power, or half power, based on Ts.

If Ts is not less than T1 at step 210, the power to the second heater is turned off at step 213 and Ts is compared to a second temperature T2 at step 214. If Ts is less than T2, temperature Ts is again measured at step 209. If Ts is greater than T2 at step 214, and Ts is less than Tmax at step 218, power is reduced to the first heater at step 216 and the temperature Ts is again measured at step 209. If Ts is greater than T2, at step 214 and Ts is greater than Tmax at step 218, an over temperature condition has been detected and all power is removed from the lamp at step 220. The first heating element is preferably the lamp 22 and the second heating element is preferably the heater 28.

The temperature control methods regulate the liquids in the container to reach and maintain a temperature within a range preferred for the general operating temperature of the lamp. In general, the lower the temperature, the less chemical reactions that occur and at higher temperatures, for example, above 120 degrees Fahrenheit, a slow but continual break down of both the first liquid (generally a wax and its constituent components) and the surfactant and additives which reside in the water phase of said display takes place. The basic function of the lamp operates on the expansion and contraction of heated first liquid. The hotter the first liquid (and second liquid), the greater tendency of the said first liquid to rise, and in some cases, stay at top of said lamp. Too low of temperature creates a stall condition and the first liquid will remain at bottom of the lamp, and in some cases, re-solidify into a non-flowing solid. Preferably, the lamp is operated below 120 degree Fahrenheit, and more preferably T1 is approximately 110 degrees Fahrenheit and T2 is approximately 120 degree Fahrenheit. To maintain a preferred temperature, the second heater may be turned on to half power if Ts is below approximately 114 degrees Fahrenheit, and the second heater may be turned on to full power if Ts drops below 110 degrees Fahrenheit. More preferably, the heaters are provided power to maintain a three degrees Fahrenheit operating range (i.e., hysteresis). Tmax is preferably approximately 160 degrees Fahrenheit.

Heating the second liquid initially as described in steps 202-206 is preferred because melting the first liquid (e.g., the wax) first may result in undesired cooperation of the first liquid and the second liquid.

The method described in FIG. 6 may be performed with an arrangement of bi-metal strip temperature sensors and relays, with an off the shelf programmable controller, or with a custom programmable circuit. An example of a suitable off the shelf controller is the model CT15 controller made by Minco Products, Inc. In Minneapolis, Minn.

Figure 7:
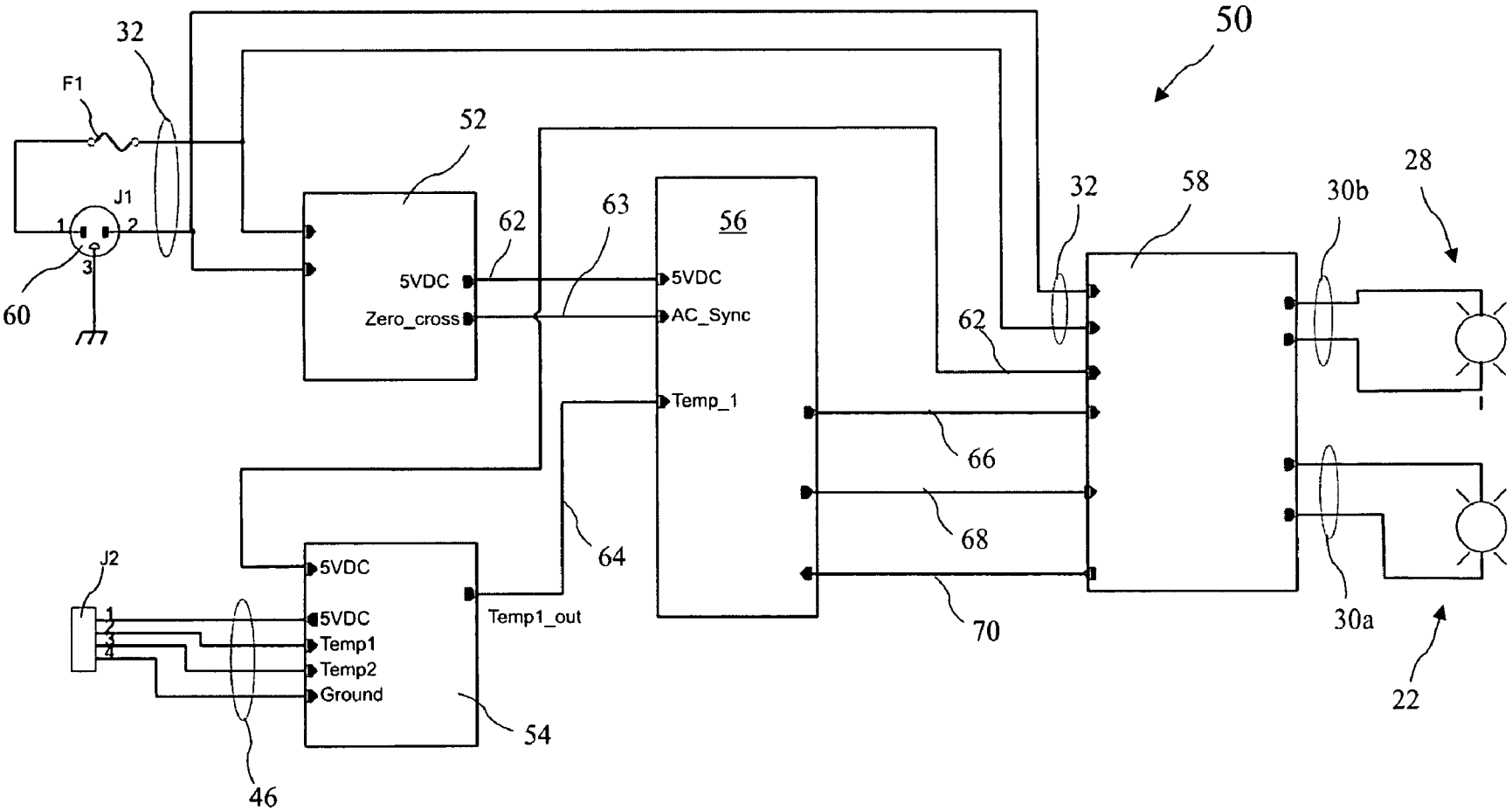
FIG. 7 is a high level view of a control circuit for the liquid motion lamp.

A high level view of a custom control circuit 50 for the liquid motion lamp is shown in FIG. 7. The circuit 50 includes a power supply 52, a sensor data processor 54, a micro controller circuit 56 and a power controller 58. The power controller 58 preferably includes at least one triac for regulating a flow of current to the heater and light. Household or commercial AC power (for example, either 120 volt or 240 volt) is provided to the circuit 50 through wires 32. The power supply 52 receives the AC power through the wires 32 (see FIGS. 4, 4A, 4B, 4C, and 4D) connected to an AC plug 60, and one of the wires 32 may include an in-series fuze F1. The power supply 52 provides a 5 volt DC power signal 62 to the micro controller circuit 56 and to the sensor data processor 54 and a zero cross signal 62 to the micro controller circuit 56.

The sensor data processor 54 provides 5 volt DC power to the temperature sensor 42 and a ground connection, and receives a first temperature signal T1 from the sensor 42 through a second connector J2. A second temperature signal T2 may optionally be received through the connector J2. The sensor data processor 54 provides a temperature measurement signal 64 to the micro controller circuit 56.

The power controller 58 receives the AC power from the AC plug 60 and also receives a heater control signal 66 and a lighting control signal 68 from the micro controller circuit 56. A current feedback signal 70 representing the current provided to the heater 28 or the light 22 is provided to the micro controller circuit 56 from the power controller 58. The power controller 58 provides power to the light 22 through wires 30*a* and to the heater 28 through wires 30*b*.

Figure 8:
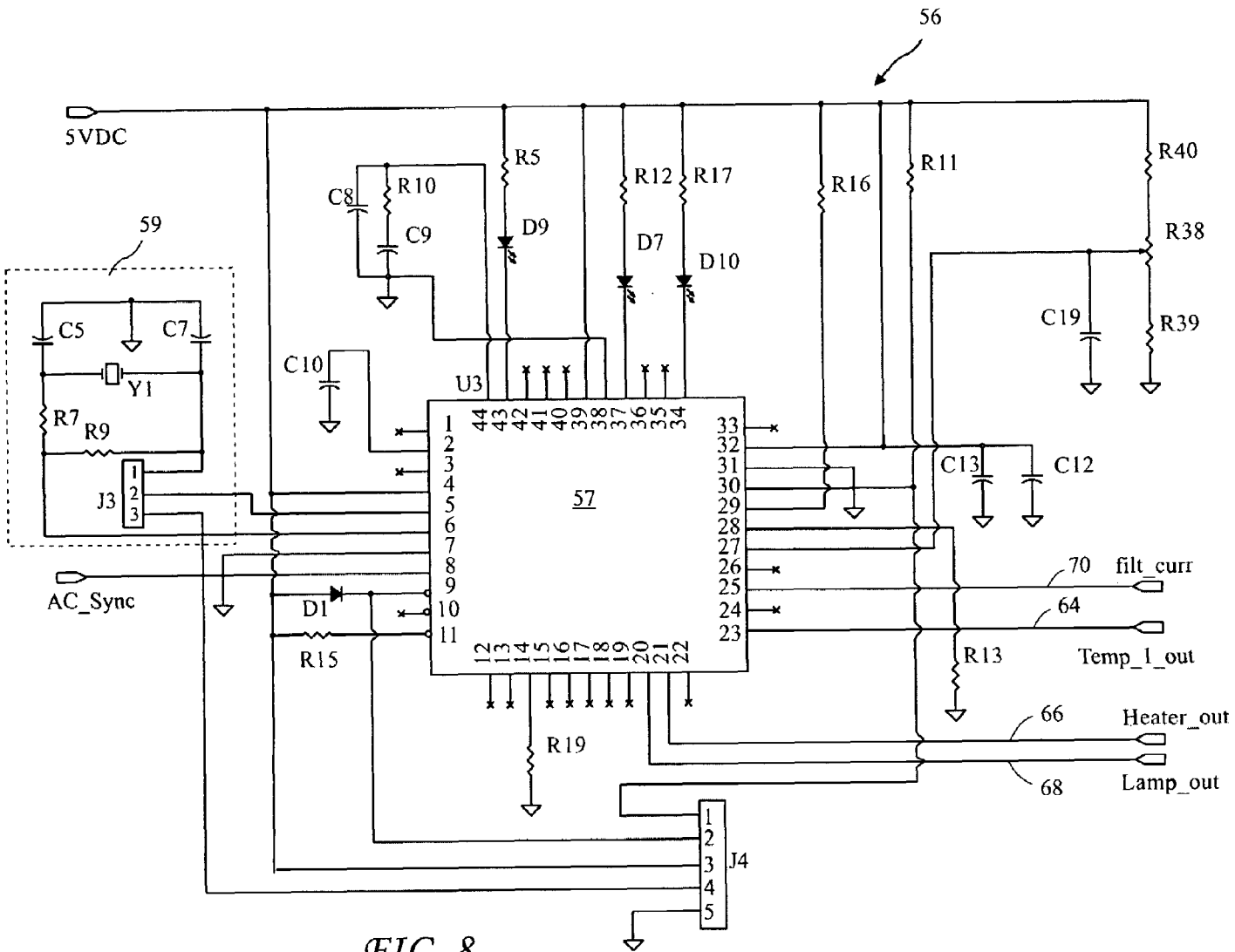
FIG. 8 is a micro controller element of the control circuit.

A detailed diagram of the micro controller circuit 56 of the control circuit 50 is shown in FIG. 8. The micro controller circuit 56 includes a micro controller 57. A suitable micro controller 57 is a model number MC68HC908AP16 Micro-Controller Unit (MCU) made by Freescale Semiconductor, Inc. | Terminals for a microprocessor 57 of the micro controller circuit 56 are described in Table 1 and a similar MCU may be used with appropriate connections.

TABLE 1

| Terminal | Signal |
|---|---|
| 1 | PTB6/T2CH0 |
| 2 | VREG |
| 3 | PTB5/T1CH1 |
| 4 | VDD |
| 5 | OSC1 |
| 6 | OSC2 |
| 7 | VSS |
| 8 | PTB4/T1CH0 |
| 9 | IRQ |
| 10 | PTB3/RxD |
| 11 | RST |
| 12 | PTB2/TxD |
| 13 | PTB1/SCL |
| 14 | PTB0/SDA |
| 15 | PTC7/SCRxD |
| 16 | PTC6/SCTxD |
| 17 | PTC5/SPSCK |
| 18 | PTC4/SS |
| 19 | PTC3/MOSI |
| 20 | PTC2/MISO |
| 21 | PTC1 |
| 22 | PTC0/IRQ2 |
| 23 | PTA7/ADC7 |
| 24 | PTA6/ADC6 |
| 25 | PTA5/ADC5 |
| 26 | PTA4/ADC4 |
| 27 | PTA3/ADC3 |
| 28 | PTA2/ADC2 |
| 29 | PTA1/ADC1 |
| 30 | PTA0/ADC0 |
| 31 | VREFL |
| 32 | VREFH |
| 33 | PTD7 |
| 34 | PTD6 |
| 35 | PTD5 |
| 36 | PTD4 |
| 37 | PTD3 |
| 38 | VSSA |
| 39 | VDDA |

TABLE 1-continued

| Terminal | Signal |
|---|---|
| 40 | PTD2 |
| 41 | PTD1 |
| 42 | PTD0 |
| 43 | PTB7 |
| 44 | CGMXFC |

Pins on the micro controller 57 are connected as follows. Pins 1, 3, 10, 12, 13, 15, 16, 17, 18, 19, 22, 24, 26, 33, 35, 36, 40, 41, and 42 are not connected to elements of the micro controller circuit 56. The remaining pins are connected to:

Pin 2 is connected to ground through a 1 μf capacitor C10.

Pin 4 is connected to the 5 volt DC power signal 62.

Pin 5 is connected to a second pin of a connector J3 of a clock 59.

Pin 6 is connected to the clock 59.

Pin 7 is connected to ground.

Pin 8 is connected to the zero cross signal 63.

Pin 9 is connected to through a diode D1 (current toward pin 9) to the 5 volt DC power signal 62.

Pin 11 is connected through a 100K resister R15 to the 5 volt DC power signal 62.

Pin 14 is connected through a 10K resister R19 to ground.

Pin 20 is connected to the lamp out signal 66 (see (FIG. 7).

Pin 21 is connected to the heater out signal 68 (see (FIG. 7).

Pin 23 is connected to the sensor data signal 64 from the sensor data processor 54.

Pin 25 is connected to the current input signal 70 (see FIG. 7).

Pin 27 is connected through a 1K resister R40 and a 10K resister R38 to the 5 volt DC power signal 62.

Pin 28 is connected through a 10K resister R13 to ground.

Pin 29 is connected through a 22K resister R16 to the 5 volt DC power signal 62.

Pin 30 is connected through a 22K resister R11 to the 5 volt DC power signal 62.

Pin 31 is connected to ground.

Pin 32 is connected to ground through in-parallel 1 μf capacitor C13 and 0.1 μf capacitor C12.

Pin 34 is connected to the 5 volt DC power signal 62 through in-series 560 ohm resister R17 and red LED D10 (current toward pin 34).

Pin 37 is connected to the 5 volt DC power signal 62 through in-series 560 ohm resister R12 and yellow LED D7 (current toward pin 37).

Pin 38 is connected to ground.

Pin 39 is connected to the 5 volt DC power signal 62.

Pin 43 is connected to the 5 volt DC power signal 62 through in-series 560 ohm resister R5 and red LED D9 (current toward pin 43).

Pin 44 is connected to an RC circuit.

Figure 9:
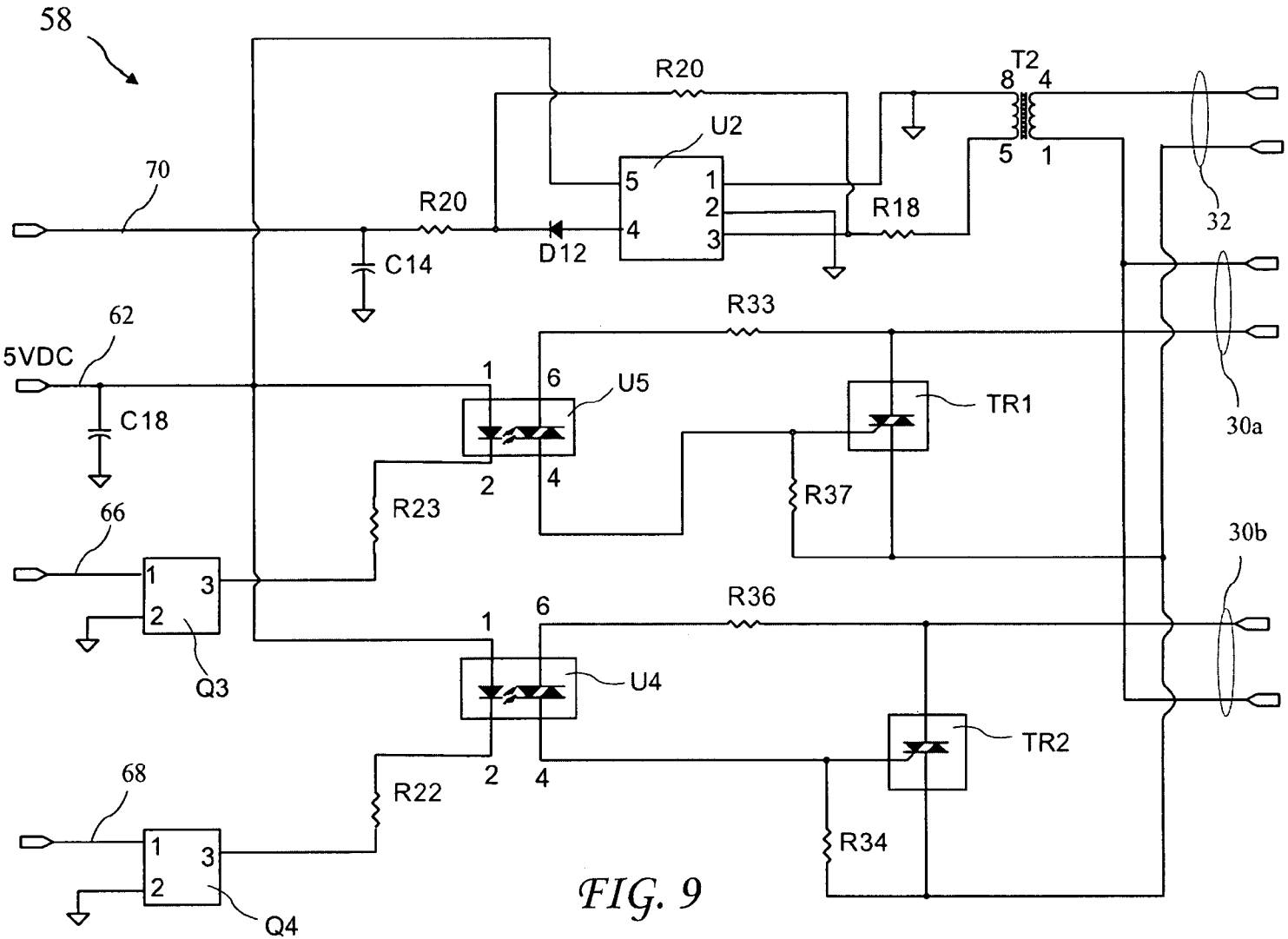
FIG. 9 is a power controller element of the control circuit.

A detailed diagram of the power controller 58 of the control circuit 50 is shown in FIG. 9. The power controller 58 receives AC power through wires 32 and the 5 volt DC power signal 62 from the power supply 52. The power controller 58 includes two high power triacs TR1 and TR2 utilizing phase power control to control the flow of electricity to the first heat source 22 (preferably a lamp) and to the second heat source 28*a*, 28*b*, or 28*c* (see FIGS. 4A, 4B, 4C) through wires 30*a* and 30*b* respectively. The concept of phase angle control is to apply only a portion of the ac waveform to the load. Once fired, the Triac will conduct until the next zero crossing. The average voltage is proportional to the shaded area under the curve. The phase angle is measured from the trigger point to the next zero crossing to provide precise control. Suitable triacs TR1 and TR2 are model BTA24-600BW triacs made by Snubberless & Standard in Carrollton, Tex.

The triacs TR1 and TR2 are controlled through isolators U5 and U4 respectively which isolate the high power switched by the triacs from the low voltage control circuit. Preferably, the isolators U5 and U4 are optoisolators, for example, model MOC3022 optoisolators made by Fairchild Semiconductor in South Portland, Me.

The optoisolators U4 and U5 receive the heater and lamp control signals 66 and 68 through bias resistor transistors Q3 and Q4. An example of suitable bias resistor transistors Q3 and Q4 is a model MUN5211 made by On Semiconductor in Phoenix, Ariz.

A second transformer T2 is connected in series with the AC power output to the heater 28 and the lamp 22 and the resulting signal is processed by the power controller 58 to provide current sensing. The sensed current signal is provided from the transformer T2 to an operational amplifier U2 and a rectifier comprising a switching diode D12 (for example a model RLS4148 switching diode made by ROHM Co. in Plano, Tex.), a 4.7K resister R20, and a 10K resister R18. The operational amplifier U2 is preferably a general purpose operational amplifier, for example, a model LMV321 made by National Semiconductor in Santa Clara, Calif. Output of the rectifier (the diode D12) is filtered using the resister R20 and a 1 μf capacitor C14 to provide a filtered output 70. The filtered output 70 is connected to channel 5 (pin 25) of the Analog to Digital converter on the micro controller 57. Software uses the filtered signal 70 to determine the health of the heater and the Lamp circuit.

Figure 10:
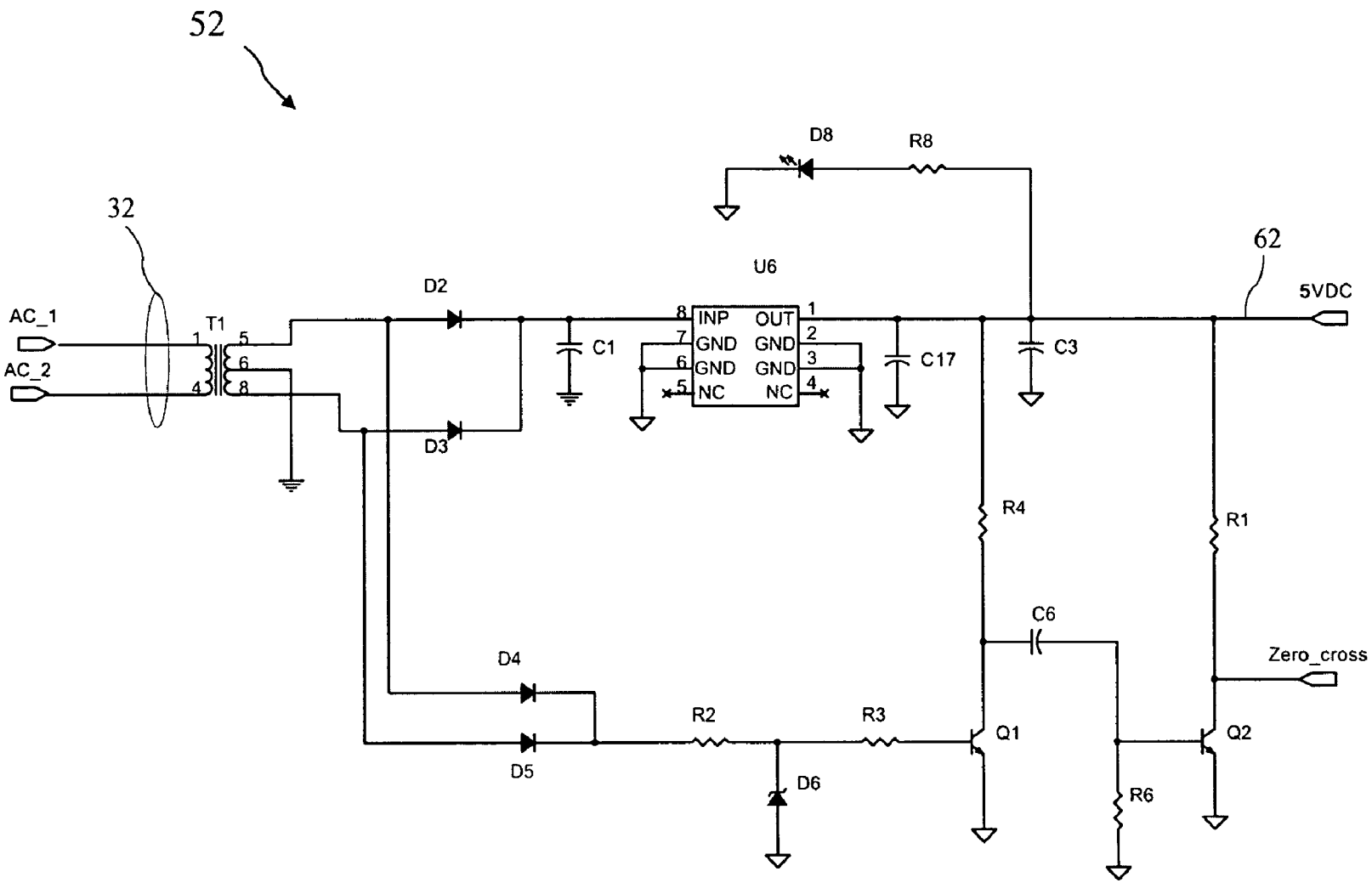
FIG. 10 is a power supply element of the control circuit.
Figures 11A, 11B:
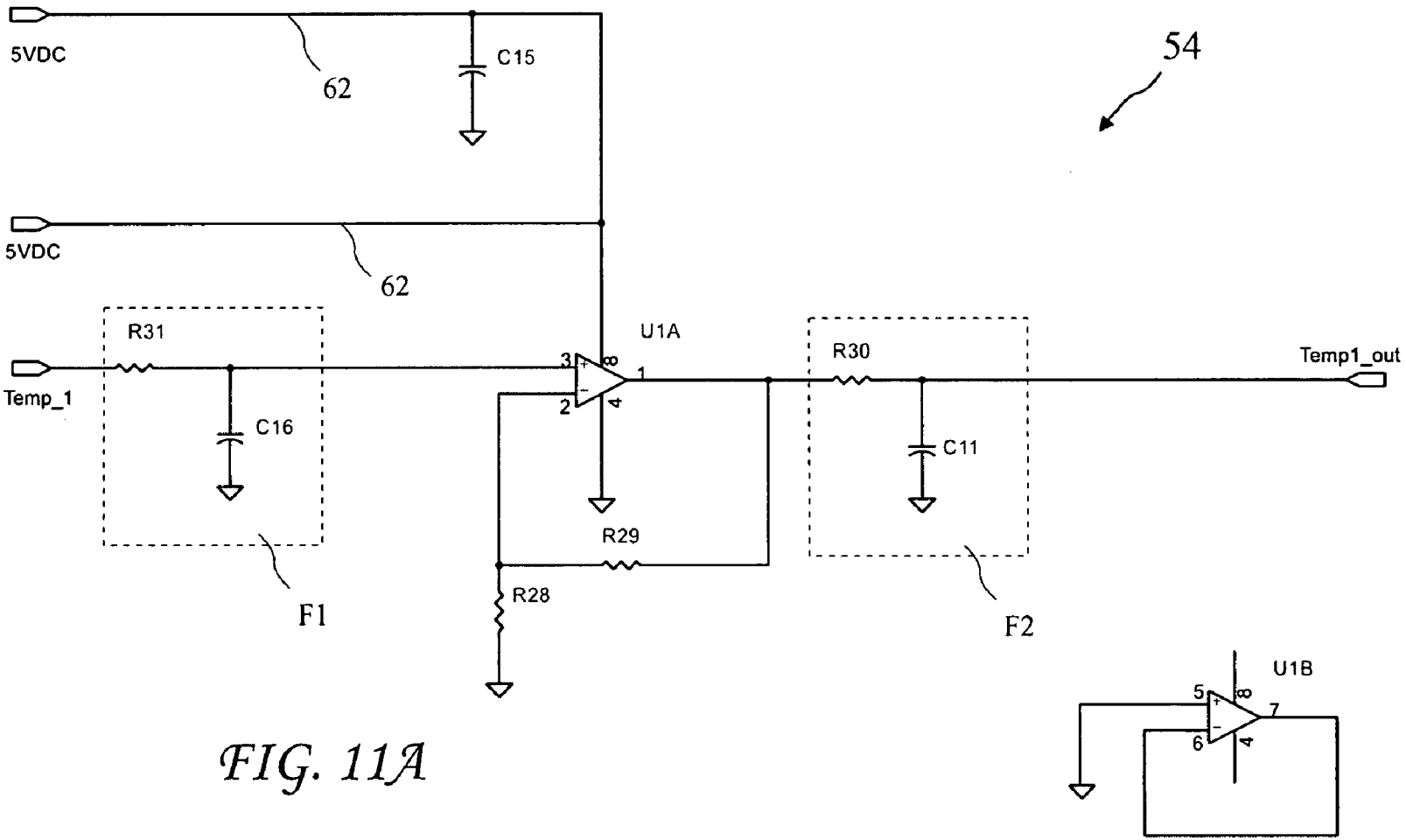
FIG. 11A is a sensor element of the control circuit.
FIG. 11B is an alternative embodiment of the sensor element of the control circuit.

A detailed diagram of the power supply 52 of the control circuit 50 is shown in FIG. 10. The power supply section 52 has two functions: provide the 5 volt DC signal for all of the circuits; and an AC line synchronization pulse for zero crossing circuit in the power controller 58 (see FIG. 9). A first transformer T1 is used as a step down transformer providing an eight volt AC signal and diodes D2 and D3 and 1000 μf capacitor C1 form a full way rectifier to provide a rectified DC power signal. An example of a suitable transformer T1 is a model SB2816-1614 made by Tamura Corp. with US offices in Temecula, Calif.

A 5V linear voltage regulator U6 with a 1000 μf capacitor C17 used as an output filter capacitor and a 0.33 μf capacitor C3 as high frequency rejection capacitor to provide the 5 volt DC power signal 62. Diodes D4 and D5 produce a full waveform on the base of a first NPN general purpose transistor Q1, the collector of Q1 goes low at every 180 of the 60 Hz input cycle. A 10K resistor R4, 0.01 μf capacitor C6, 100K resister R6 and second NPN general purpose transistor Q2 form a narrow pulse generator which is synchronized with the 60 Hz AC line frequency. The narrow pulses are used by the microprocessor 57 to generate the appropriate phase delay pulses to fire the triac devices TR1 and TR2 (see FIG. 9) used to control the power provided to heater and the lamp. An example of a suitable transistor Q1 is a model MMST3904 made by ROHM in Piano, Tex.

A diode D8 is connected to the 5 volt DC power signal 62 providing a Green LED used as power available indicator.

A detailed diagram of the sensor data processor 54 of the control circuit 50 is shown. The lamp 10 preferably includes a very accurate solid-state temperature sensor 42 embedded with the heater element in the Lava lamp, which sensor 42 is preferably a Resistive Thermal Device (RTD) sensor. Output of the sensor 42 is filtered through a first low pass filter F1 formed by a 4.7 K ohm resister R31 and a 0.33 μf capacitor C16. The low pass filter provides a very steep roll off to reduce noise in the system. An operational amplifier U1A is used as a multiply by two amplifier and very high impedance load for the filter. Output from the amplifier UA1 passes through a second filter F2 formed by a 10K ohm resister R30 and a 0.33 μf capacitor C11 to reduce or eliminate high frequency noise passed to the analog to digital converter inside the microprocessor 57.

Large lamps including the control circuit 40 also pose problems in blending the first liquid and in shipping. These issues are addressed in U.S. patent application Ser. No. 10/856,457, filed Jun. 1, 2004, for "LIQUID MOTION LAMP" filed by the applicant of the present invention and incorporated above by reference.

While the invention herein disclosed has been described by means of specific embodiments and applications thereof, numerous modifications and variations could be made thereto by those skilled in the art without departing from the scope of the invention set forth in the claims.

I claim:

1. A method for controlling a liquid motion lamp, the method comprising:

measuring a temperature Ts of at least one of a first liquid residing in a container and a second liquid residing in the container using a temperature sensor, the second liquid adapted to cooperate with the first liquid, wherein the first liquid has a lesser density than the second liquid at a higher temperature, and the first liquid has a greater density than the second liquid at a lower temperature;

providing the temperature measurement Ts to a control circuit;

generating a first heater power signal by the control circuit responsive to the temperature measurement Ts;

providing the first heater power signal to a first heat source in thermal communication with the first liquid and the second liquid; and controlling the first heater power signal to maintain the first liquid and the second liquid in a desired temperature range.

2. The method of claim 1, wherein controlling the first heater power signal to maintain the first liquid and the second liquid in a desired temperature range includes setting the first heater power signal to zero if the temperature measurement Ts exceeds a maximum temperature Tmax.

3. The method of claim 1 wherein the first heat source is also a light source.

4. The method of claim 3, further including:

a second heat source in thermal communication with at least one of the first liquid and the second liquid; and at initial turn on of the liquid motion lamp, providing a second heater power signal to the second heat source to initially heat the first liquid and the second liquid.

5. The method of claim 4, further including after initial turn on, when the measured temperature Ts initially reaches a lower operating temperature T1:

turning off the second heater power signal; and turning on the first heater power signal.

6. The method of claim 5, further including:

after the measured temperature Ts initially reaches the lower operating temperature T1 a first time:

if the measured temperature Ts drops below the lower operating temperature T1, turning on the second heater power signal; and if the measured temperature Ts is the lower operating temperature T1, turning off the second heater power signal.

7. The method of claim 6, wherein controlling the first heater power signal to maintain the first liquid and the second liquid in a desired temperature range includes reducing the first heater power signal to zero if the temperature measurement Ts exceeds a higher temperature T2.

8. The method of claim 7, further including turning off all power to the liquid motion lamp if the temperature measurement Ts exceeds a maximum temperature Tmax.

9. The method of claim 7, wherein the second heat source does not produce visible light.

10. The method of claim 7, wherein the second heat source is between an approximately 750 watt and an approximately 1500 watt heat element.

11. A method for controlling the temperature of a liquid motion lamp, the method comprising:

measuring a temperature Ts of liquid in the lamp;

if the temperature Ts is less than a minimum temperature T1, turning on power to a second heating element in the lamp, and after a brief period of time, again measuring the temperature Ts;

If the temperature Ts is not less than the temperature T1:

turning off power to the second element and on turning power to a first heating and lighting element; and measure the temperature Ts;

comparing the temperature Ts to the temperature T1;

if the temperature Ts is less than the temperature T1, turning the second heating element on, and after a brief period of time, again measuring the temperature Ts;

if the temperature Ts is not less than the temperature T1, and the temperature Ts is greater than a temperature T2 and the temperature Ts is less than Tmax, reducing the power to the first heating and lighting element, and after a brief period of time, again measuring the temperature Ts; and if the temperature Ts is not less than the temperature T1 and the temperature Ts is greater than Tmax, turning off all power to the heating elements.

12. A method for controlling the temperature of liquids in a liquid motion lamp, the method comprising:

preheating a liquid motion lamp comprising steps of:

providing power to a second heating element in thermal communication with the liquids in the liquid motion lamp;

measuring a temperature Ts of the liquids in the liquid motion lamp; and when the measured temperature Ts of the liquids exceeds a lower temperature T1, removing power from the second heat source and operating the liquid motion lamp;

the operating the liquid motion lamp comprising the steps of:

providing power to a first heating element in thermal communication with the liquids and providing lighting to the liquids in the liquid motion lamp;

measuring the temperature Ts of the liquids in the liquid motion lamp;

if the measured temperate Ts of the liquids is below the lower temperature T1, providing power to the second heating element and continuing operating the liquid motion lamp; and if the measured temperate Ts of the liquids is not below the lower temperature T1, removing power from the second heat source and continue operating the liquid motion lamp.

13. The method of claim 12, wherein the operating the liquid motion lamp further includes:

if the measured temperature Ts is greater than an upper temperature T2, reducing power to the first heating element.

14. The method of claim 12, wherein the operating the liquid motion lamp further includes:

if the measured temperature Ts is greater than a maximum temperature Tmax, removing all power from the heating elements.

* * * * *